US008992659B2

(12) United States Patent
Larsson et al.

(10) Patent No.: US 8,992,659 B2
(45) Date of Patent: Mar. 31, 2015

(54) METAL POWDER COMPOSITION

(75) Inventors: Mats Larsson, Lerberget (SE); Karin Olsson, Helsingborg (SE); Hilmar Vidarsson, Munka Ljungby (SE)

(73) Assignee: Hoganas AB (Publ), Hoganas (SE)

( * ) Notice: Subject to any disclaimer, the term of this patent is extended or adjusted under 35 U.S.C. 154(b) by 0 days.

(21) Appl. No.: 13/394,018

(22) PCT Filed: Sep. 1, 2010

(86) PCT No.: PCT/EP2010/062796

§ 371 (c)(1),
(2), (4) Date: Apr. 5, 2012

(87) PCT Pub. No.: WO2011/029759

PCT Pub. Date: Mar. 17, 2011

(65) Prior Publication Data

US 2012/0187611 A1 Jul. 26, 2012

Related U.S. Application Data

(60) Provisional application No. 61/240,393, filed on Sep. 8, 2009.

(30) Foreign Application Priority Data

Sep. 8, 2009 (SE) ..... 0901160

(51) Int. Cl.

| | |
|---|---|
| ***B22F 1/00*** | (2006.01) |
| ***B22F 1/02*** | (2006.01) |
| ***C22C 1/05*** | (2006.01) |
| *B22F 3/02* | (2006.01) |
| *C22C 33/02* | (2006.01) |

(52) U.S. Cl.

CPC ..... *B22F 1/0059* (2013.01); *B22F 1/0077* (2013.01); *B22F 3/02* (2013.01); *B22F 2001/0066* (2013.01); *B22F 2003/023* (2013.01); *B22F 2998/00* (2013.01); *B22F 2998/10* (2013.01); *C22C 33/02* (2013.01)

USPC ..... 75/255; 75/231; 419/10

(58) Field of Classification Search

USPC ..... 75/252, 255, 231; 508/151; 419/10

IPC ..... B22F 1/0059,2003/023

See application file for complete search history.

(56) References Cited

U.S. PATENT DOCUMENTS

| | | | | |
|---|---|---|---|---|
| 5,744,433 | A | 4/1998 | Storstroem et al. | |
| 6,511,945 | B1 * | 1/2003 | Ramstedt | 508/151 |
| 6,605,251 | B1 | 8/2003 | Vidarsson | |
| 2006/0000310 | A1 * | 1/2006 | Solimnjad | 75/252 |

FOREIGN PATENT DOCUMENTS

| | | | |
|---|---|---|---|
| EP | 1 179 607 | A2 | 2/2002 |
| WO | WO 03/031099 | A1 | 4/2003 |

OTHER PUBLICATIONS

International Search Report (PCT/ISA/210) issued on Dec. 28, 2010, by European Patent Office as the International Searching Authority for International Application No. PCT/EP2010/062796.

Written Opinion (PCT/ISA/237) issued on Dec. 28, 2010, by European Patent Office as the International Searching Authority for International Application No. PCT/EP2010/062796.

* cited by examiner

*Primary Examiner* — Weiping Zhu

(74) *Attorney, Agent, or Firm* — Buchanan Ingersoll & Rooney P.C.

(57) ABSTRACT

A metal powder composition including: an iron or iron-based powder composition, and a lubricating combination including a substance A, a substance B, and a substance C; wherein: substance A is a polyolefin, substance B is chosen from a group of saturated and unsaturated fatty acid amides, saturated and unsaturated fatty acid bisamides, saturated fatty alcohols and fatty acid glycerols, and substance C is an amide oligomer having a molecular weight between 500 g/mol and 30 000 g/mol; and wherein the amounts of respective substances A, B and C in weight percent of the iron or iron-based powder composition are: $0.05 \leq A+B < 0.4$ wt %, $C \geq 0.3$ wt %, $A+B+C \leq 2.0$ wt %, and the relation between substances A and B is: $B/A > 0.5$. Also, a method of producing a metal powder composition and a method for producing a green component.

20 Claims, No Drawings

METAL POWDER COMPOSITION

FIELD OF THE INVENTION

The present invention relates to a metal powder composition containing a lubricating combination, as well as to a method of producing a metal powder composition containing a lubricating combination and a method for producing a green component having high green strength.

BACKGROUND OF THE INVENTION

In industry, the use of metal powder products manufactured by compacting and sintering metal powder compositions is becoming increasingly widespread. A number of different products of varying shape and thickness are being produced, and the quality requirements placed on these products are constantly increasing.

There are several advantages with using powder metallurgical methods for producing structural parts compared to machining or casting. As net shape or near net shape components can be produced, the material utilisation is much higher compared to machining of a components from ingot or wrought steel, and the energy consumption is much lower compared to when producing components by casting.

In order to facilitate the compaction and ejection of the compacted component from the die, lubricants are added to the metal powder composition. The lubricant is intended to reduce the friction between the individual powder particles during the compaction step, promoting the possibility of reaching high green density as well as being able to form a lubricating layer between the surfaces of the component and the die during the ejection step and reducing the force needed in order to eject the component as well as prohibiting scoring or the formation of scratch marks on the surface of the ejected component. Furthermore, a good lubricant shall not negatively influence the powder properties, i.e. apparent density, AD, and flow. AD is a measure of the bulk density of the powder or the volume occupied by the powder composition after filling of the die, expressed as grams/cm$^3$, and measured according to ISO 3923-1. Flow is a measure of how fast a fixed amount, 50 grams, of the powder composition can flow through a standardized funnel, measured in seconds. The method is described in ISO 4490. Normally a high value of AD is preferred allowing shorter punches and shorter ejection distances to be used. High filling speed, i.e. low flow value in seconds, is preferred as the time for filling is shorter allowing increased production speed.

By adding a binder, which also may act as a lubricating substance, finer particles such as graphite and other alloying substances in the iron-based powder composition can be bound to the surface of the coarser iron or iron-based powder thus preventing segregation in the composition. Such segregation may otherwise lead to varying properties within the compacted part and increased weight scatter between compacted parts.

Apart from the above mentioned characteristics imposed on a high quality lubricant used in the press and sinter technology of metal powder such a lubricant need also render high green strength to the compacted part. Green strength, i.e. the strength of a component before sintering defined and measured according to ISO 3995, is one of the most important physical properties of green parts. The importance of this property increases with increased complexity of the compacted part. Green strength increases with increased compact density and is influenced by type and amount of lubricant admixed to the powder. The type of iron powder used will also influence the green strength, sponge iron powder having more irregular shape, result in higher green strength compared to atomised iron powder despite the fact that higher green density of the compacted component is obtained when using atomised iron powder. Thus, there is a need of providing a lubricant giving high green strength especially to components made from atomised iron-based powder compositions. In order to increase the green strength the compacted body may be heat treated before sintering.

High green strength is required in order to prevent compacted parts from cracking during ejection from the die and prevent them from getting damaged during the handling and transportation between he press and the sintering furnace. Another advantage obtained by high green strength is the possibility of machining the green component prior to sintering which is of course far more easier than machining the sintered component. This advantage is more pronounced the higher the hardness and strength are of the sintered component, making machining of the green component more attractive compared to machining of the sintered component. This will be specially evident in the case of the component being sinter-hardened.

The development within the powder metallurgical field and especially directed to iron-based powder compositions for pressing and sintering has been intensive and to a great extent focused on bringing new and enhanced lubricants improving the powder properties, die lubrication, green density or green strength. However it has been difficult to obtain a lubricating substance improving all of the essential properties as some of them seem to counteract each other. It is therefore a need to obtain such a lubricant or lubricating composition improving all of these essential properties, especially when used in an atomised iron-based powder composition.

The patent application WO 03/031099 to Ramstedt describes a lubricating combination essentially consisting of 10-60% by weight of polyethylene ether and the remainder being an oligomer amide. This combination enhances the green strength of the compacted part.

U.S. Pat. No. 6,605,251 to Vidarsson discloses a polyolefin-based polymer having a weight average molecular weight of 500-10 000 as well as a method for obtaining high green strength of the compacted part by heating the compacted part up to a temperature above the melting point peak of the polyolefin based polymer. It has however been noticed that when using such polyolefines alone as lubricating agents in powder metallurgical compositions a so called stick-slip phenomenon occurs during the ejection of the compacted body from the die. This means that the body tends to stick to the wall of the die during the ejection, instantaneously increasing the ejection force, and when the component slip, the ejection force needed is instantaneously decreased. This will recur at a high frequency causing a creaky noise, vibrations, high stress on the part subjected to ejection and risk of cracking the part. The stick-slip phenomenon is also revealed as a spiny ejection force curve when logging the ejection force as a function of ejected distance.

SUMMARY OF THE INVENTION

An object of the invention is to provide compacted bodies having high green strength of minimum 30 MPa, ensuring durability for handling and to ensure machining of the body, even at moderate green densities of about 6.8-7.1 g/cm$^3$.

Another object of the invention is to provide a method for producing such compacted parts.

Still another object of the invention is to provide a new lubricating combination enabling the manufacture of such compacted parts.

A further object of the invention is to provide an iron-based powder composition suitable for producing compacted bodies having high green strength, the powder composition enabling free flowing and non segregated filling of the compaction tool at a high speed and providing high apparent density of the filled powder value.

Still a further object of the invention is to provide an iron-based powder composition enabling production of compacted parts having high green density and being possible to eject from the die showing a minimum of the so called stick slip phenomena.

It has now been found that by a careful selection of lubricants, a new lubricating combination for powder compositions for powder metallurgy has been obtained which enhances not only the powder properties such as apparent density and flow, but also results in a surprisingly high green strength after heat treatment of the compacted component. Furthermore, segregation of finer particulate components in the iron-based powder composition is prevented as the lubricating combination is also used as a binding agent.

In order to obtain even higher green strength than what is obtained directly after the compaction step the compacted part is preferably heat treated at a temperature above the melting point peaks of the components in the lubricating combination.

Examples of components which may be produced from iron- or iron-based powder compositions containing the new lubricating combination are main bearing caps, cam caps, VVT components, valve guides, valve seat inserts, planetary carrier, cam lobes, gears, connecting rods, cam shaft and crank shaft sprockets. Other examples are components for soft magnetic applications such as rotor or stator cores for electrical motors and generators and inductors in ignition coils. For soft magnetic applications graphite is not normally added to the metal powder composition and the compacted components are normally not sintered.

According to one aspect of the invention, there is provided a metal powder composition comprising: an iron or iron-based powder composition, and a lubricating combination comprising a substance A, a substance B, and a substance C; wherein substance A is a polyolefin, substance B is chosen from a group consisting of saturated and unsaturated fatty acid amides, saturated and unsaturated fatty acid bisamides, saturated fatty alcohols and fatty acid glycerols, and substance C is an amide oligomer having a molecular weight between 500 g/mol and 30 000 g/mol; and wherein the amounts of respective substances A, B and C in weight percent of the iron or iron-based powder composition are: $0.05 \leq A+B < 0.4$ wt %, $C \geq 0.3$ wt %, $A+B+C \leq 2.0$ wt %, and the relation between substances A and B is: $B/A > 0.5$.

According to another aspect of the invention, there is provided a method for producing a metal powder composition comprising the steps of: providing a lubricating combination according to the above aspect of the invention; mixing the lubricating combination with an iron or iron-based powder; heating the mixture to a temperature above the melting point peak for substance A but below the melting point peak for substance C; cooling the heated mixture during mixing in order to bond finer particles to the surface of the iron- or iron-based powder particles.

The mixture may be heated to a temperature which is also above the melting point peak of substance B.

During the cooling of the heated mixture, the melted substance A, and possibly substance B, solidifies. The melting and subsequent solidification of substance A, and possibly substance B, allows the finer particles to bind to the iron- or iron-based powder particles by means of the lubricating combination.

If the mixture is heated to above the melting point peak for substance A only, and not substance B, substance B must have a higher melting point than substance A. Substance B may then, depending on the choice of substance A, e.g. be a saturated fatty acid bisamide.

If the mixture is heated to above the melting point peaks for both substances A and B, substance B may have a melting point that is higher, lower or the same as substance A. Substance B may then e.g. be a saturated or unsaturated fatty acid amide, an unsaturated fatty acid bisamide, a saturated fatty alcohol or a fatty acid glycerol.

According to yet another aspect of the invention, there is provided a method for producing a green component having enhanced green strength comprising the steps of: providing a metal powder composition according to the method of the above aspect of the invention; compacting the metal powder composition in a die at a die temperature between ambient temperature and 100° C. at a compaction pressure of 400-1 500 MPa to obtain a compacted component; and ejecting the compacted component from the die.

DETAILED DESCRIPTION OF THE INVENTION

Currently preferred embodiments of the present invention will now be described. These embodiments are not limiting to the scope of the present invention as defined by the claims.

The lubricating combination according to the invention comprises three defined substances, A, B and C. Substance A being a polyolefin giving lubricating properties during compaction and ejection of the compacted body and acting as a binding agent in the metal powder composition. Substance B, also acting as lubricant and binding agent, being a organic substance based on a fatty acid but having a functional group less reactive than the carboxylic group of the fatty acid against the surface of the die wall and the iron or iron-based powder of the compact. Further the lubricating combination includes a substance C, acting as a green strength enhancing agent, chosen from the group of amide oligomers. The affinity of substance B to the die surface and iron or iron-based powder of the compact shall be high enough in order to create a sufficiently lubricating layer on the die wall but low enough in order to not prohibit the other substances, such as substance C, of creating a firm bond between the individual iron or iron-based powder particles of the green component after heat treatment. The substances A and B may have a melting point below that of substance C.

Preferably substance A is a polyethylene wax having a weight average molecular weight of 400-10 000. A weight average molecular weight below 400 may adversely affect the powder properties and above 10 000 the lubricating properties may be insufficient. Examples of suitable polyolefines are Polywax™ 655, Polywax™ 1000, Polywax™ 2000 and Polywax™ 3000 all available from Baker Petrolite. Other examples are polyethylene waxes of Fisher-Tropsch types, such as Sasolwax™ C77 and Sasolwax™ C80 obtained from Sasol Wax.

Substance B could be chosen from the group of saturated and unsaturated fatty acid amides such as lauric acid amide, myristic acid amide, palmitic acid amide, stearic acid amide, oleic acid amide, arachaic acid amide, behenic acid amide and erucic acid amide; saturated fatty acid bisamides such as ethylene bis-stearamide; unsaturated fatty acid bisamides such as ethylene-bis-oleamide, ethylene-bis-erucamide, hexylene-bis-oleamide and hexylene-bis-erucamide; saturated fatty alcohols such as myristc alcohol, cetyl alcohol, stearyl alcohol, archidyl alcohol and behenylalcohol; or saturated fatty acid glycerols such as glycerol 1-monostearate and glycerol 1,2-distearate; or mixtures thereof.

Substance C is an amide oligomer and may have a weight average molecular weight between 500 and 30 000, preferably between 1 000 and 15 000 and a melting point peak between 120° C. and 200° C. Further the amide oligomer may be derived from lactams containing the repeating unit;

$$—[NH—(CH_2)_m—CO]_n—$$

wherein m is an integer in the range of 5-11 and n is an integer in the range of 5-50. The oligomer may alternatively or additionally be derived from diamines and dicarboxylic acids and contain the repeating unit $$—[NH—(CH_2)_k—NHCO(CH_2)_l—CO]_x—$$

wherein k and l are integers in the range of 4-12, k+l being greater than 12 and x being an integer in the range of 2-25. Examples of substance C are Orgasol™ 3501 and Orgasol™ 2001 available from Arkema, France.

The relations between substance A, B, and C are as according to below, the amounts of substances A, B and C being expressed as weight percentage of the total weight of the iron or iron-based powder composition;

$$B/A>0.5$$

$$0.05\leq A+B<0.4\%$$

$$C>0.3\%$$

$$A+B+C\leq 2.0\%$$

Higher amount of A than 0.5*B may result in stick-slip, amounts of A+B of 0.4% and above and/or amount of C of less than 0.3%, may result in worsened green strength. Too low amounts of A and B may result in insufficient lubrication and bonding properties and too high amounts of A+B+C may omit the possibility of reaching sufficiently high green density.

The lubricating combination is added to the iron-based powder composition in an amount above 0.3% up to 2%. Below 0.3% by weight neither the lubricating effect nor the impact on green strength is sufficient and above 2% by weight the lubricating combination will occupy too much volume omitting high green density to be obtained.

The iron or iron-based powders used could be any iron or iron-based powder as long as it is compatible with the press and optionally sintering technique. Examples of iron powders are gas atomized, water atomised or sponge iron powders without any intentionally added alloying elements. Examples of iron-based powders are prealloyed or diffusion-alloyed iron-based powders where alloying elements are added to the melt before atomization or adhered to the surface of the iron powder by a diffusion bonding process. Alloying elements could also be admixed to the pure iron powders or to the prealloyed or diffusion-alloyed iron-based powders.

The particle size of the iron or iron-based powders could be any as long as the iron-based compositions are suitable for conventional press and optional sintering techniques. As example the mean particle size of the iron or iron-based powders could be between 50 and 500 μm, 50-150 μm or 150-400 μm.

Graphite is frequently included in the iron or iron-based powder composition as well as other alloying elements such as copper, nickel, molybdenum, vanadium, chromium, niobium, manganese and phosphorous in order to obtain desired hardness and strength of the sintered part. These alloying elements could also be pre-alloyed or diffusion-alloyed.

Other substances such as hard phase materials, machinability enhancing agents such as manganese sulphide, boron nitride or the like and sintering enhancing agents may be included in the iron or iron-based powder composition.

In order to further enhance the flow property a flow agent such as a metal oxide described in patent application WO99/59753 may be included in and/or added to the iron or iron-based powder composition. The flow agent being added in an amount between 0.01 and 0.1% by weight.

EXAMPLES

The following examples which are not intended to be limiting present certain embodiments of the invention. Unless otherwise indicated, any percentage is of weight basis.

Preparation of the Iron-Based Powder Composition

The iron based powder or iron powder is mixed with substances A, B and C and optionally graphite and/or other alloying elements, hard phase materials, machinability enhancing agents and/or sintering enhancing agents.

During continuous mixing the temperature may be raised above the melting point peak of substance A and B but below the melting point peak of substance C followed by cooling allowing finer particles to be bound to the surface of the coarser iron or iron-based powders. During cooling a flow enhancing agent may be added.

Preparation of the Compacted Part

The iron or iron-based powder composition is transferred to a compaction die and compacted at a compaction pressure between 400 and 1 500 MPa. In order to further utilise the lubricating effect of the new lubricating combination the die may be heated to a temperature between 30° C. up to a temperature of 100° C., preferably between 50° C. up to a temperature of 90° C. After compaction the compacted component is ejected from the compaction die and transferred to a sintering furnace. In a preferred embodiment, to further improve the green strength, the compacted and ejected component is subjected to heat treatment, prior to sintering, at a temperature above the melting point of substance C, but below the temperature of decomposition of substance C, such as below 400° C. or preferably below 325° C., in air or, more preferably, in an inert atmosphere such as nitrogen. The compacted part may further be machined before sintering.

A number of iron powder compositions were prepared using various lubricating combinations added. As iron powder AHC100.29 available from Höganäs AB was used. Further, 2% of copper powder, Cu-100 available from Ecka and 0.5% of graphite, UF4 available from Firma Kropfmuhle, Germany, was added. The components were homogeneously mixed and still during mixing the temperature of the mixture was raised to about 75° C. for compositions 4, 5 and 6, 110° C. for composition 10, 125° C. for composition 15 and to 105° C. for the other compositions. The following table 1 shows the lubricating compositions used. For composition no 11 component B was added after the cooling step.

TABLE 1

| Utilised lubricating substances | | | | | | | | | |
|---|---|---|---|---|---|---|---|---|---|
| | | Substance B | | | | | Substance C | | |
| Comp. no | Substance A PW655 % | Behenyl alcohol % | Stearic acid amid % | Behenic acid amid % | Ethylene-bis-oleamide % | Stearyl erucamide | Poly phenylene sulfide % | Oligomer amide according to the invention % | Oligomer amide outside the scope of the invention n < 5% |
| 1 | 0.2 | | | | | | 0.6 | | |
| 2 | 0.2 | | | | | | | 0.6 | |
| 3 | 0.2 | | | | | | | | 0.6 |
| 4 | | 0.2 | | | | | 0.6 | | |
| 5 | | 0.2 | | | | | | 0.6 | |
| 6 | | 0.2 | | | | | | | 0.6 |
| 7 | 0.1 | | 0.1 | | | | | 0.6 | |
| 8 | 0.2 | | 0.1 | | | | | 0.5 | |
| 9 | 0.2 | | 0.2 | | | | | 0.4 | |
| 10 | 0.2 | | | 0.1 | | | | 0.5 | |
| 11 | 0.2 | | | 0.1 | | | | 0.5 | |
| 12 | 0.1 | | 0.2 | | | | | 0.5 | |
| 13 | 0.15 | | 0.15 | | | | | 0.5 | |
| 14 | 0.1 | 0.1 | | | | | | 0.6 | |
| 15 | 0.1 | | | | 0.1 | | | 0.6 | |
| 16 | 0.1 | | | | | 0.1 | | 0.6 | |

Powder Properties

Apparent density was measured according to ISO 3923-1 and flow was measured according to ISO 4490.

Green Strength

The different compositions were compacted into TRS specimens according to ISO 3995 at a compaction pressure of 600 MPa at a die temperature of 60° C. for compositions 4, 5 and 6 and at 80° C. for the other compositions.

Green strength was measured according to ISO 3995 and calculated as the mean value of three measurements. Further, green strength was also measured for samples heat treated in an atmosphere of nitrogen at different temperatures and calculated as the mean value of three measurements.

Ejection Behaviour

The different compositions were also compacted into cylinders having a diameter of 25 mm and a height of 15 mm at 600 MPa at a die temperature of 60° C. for compositions 4, 5 and 6 and at 80° C. for the other compositions. During ejection of the compacted components the ejection force was measured as a function of ejected distance and the ejection energy was calculated. It was determined if stick slip phenomenon occurred or not from the characteristics of the curve showing the logged ejection force as a function of ejected distance.

The following table 2 shows the results from the measurements.

TABLE 2

| results from measurements of powder properties, green density, green strength and ejection force, energy and behaviour. | | | | | | | | | | | |
|---|---|---|---|---|---|---|---|---|---|---|---|
| Comp. no | AD [g/cm$^3$] | Flow [s/50 g] | Green density [g/cm$^3$] | Green strength, no heat treatment [MPa] | Green strength, heat treatment 225° C. [MPa] | Green strength, heat treatment 275° C. [MPa] | Green strength, heat treatment 325° C. [MPa] | Ej. Energy [J/cm$^2$] | Ej. Force [N/mm$^2$] | Ej. Behave-our | Example |
| 1 | 2.99 | 25.6 | 6.98 | 18 | | | 32 | 40 | 35 | Stick slip | Compar-ative |
| 2 | 2.99 | 27.3 | 7.05 | 26 | 81 | 94 | | | | Stick slip | Compar-ative |
| 3 | 3.16 | 24.6 | 7.06 | 17 | | | 24 | | | Stick slip | Compar-ative |
| 4 | 3.34 | 22.7 | 6.94 | 16 | | 15 | 14 | 42 | 24 | OK | Compar-ative |
| 5 | 3.25 | 28.0 | 7.01 | 19 | 46 | 34 | 26 | 41 | 27 | Stick slip | Compar-ative |
| 6 | 3.40 | 23.3 | 7.00 | 16 | | | 21 | | | Stick slip | Compar-ative |
| 7 | 3.23 | 26.0 | 7.05 | 21 | 39 | 32 | | 48 | 26 | OK | invention |
| 8 | 3.26 | 25.0 | 7.05 | 20 | 34 | 29 | | 42 | 25 | Stick slip | Compar-ative |
| 9 | 3.25 | 24.3 | 7.04 | 20 | 26 | 26 | | 33 | 20 | OK | Compar-ative |
| 10 | 3.17 | 26.0 | | | | | | 46 | 26 | Stick slip | Compar-ative |
| 11 | 2.97 | 27.1 | 7.00 | 23 | 37 | 31 | | 51 | 26 | Stick slip | Compar-ative |

TABLE 2-continued results from measurements of powder properties, green density, green strength and ejection force, energy and behaviour.

| Comp. no | AD [g/cm$^3$] | Flow [s/50 g] | Green density [g/cm$^3$] | Green strength, no heat treatment [MPa] | Green strength, heat treatment 225° C. [MPa] | Green strength, heat treatment 275° C. [MPa] | Green strength, heat treatment 325° C. [MPa] | Ej. Energy [J/cm$^2$] | Ej. Force [N/mm$^2$] | Ej. Behave-our | Example |
|---|---|---|---|---|---|---|---|---|---|---|---|
| 12 | 2.97 | 27.1 | 7.09 | 21 | 30 | 27 | | 51 | 26 | OK | invention |
| 13 | 3.17 | 25.3 | 7.09 | 21 | 31 | 28 | | 45 | 34 | OK | invention |
| 14 | 3.19 | 25.2 | 7.06 | 22 | 61 | 59 | | 43 | 34 | OK | invention |
| 15 | 3.08 | 28.0 | 7.05 | 20 | 68 | 76 | | 43 | 35 | OK | invention |
| 16 | 3.02 | 26.5 | 7.07 | 22 | 69 | 74 | | 48 | 30 | Stick slip | Compar-ative |

Table 2 reveals that compositions 4, 7, 9, 12, 13, 14 and 15 could be compacted without occurrence of stick slip phenomenon, however the green strengths of components made from composition 4 is too low, even after heat treatment. Compositions 7, 12, 13, 14, and 15 gave sufficient green strengths and the green strengths were further improved when the components were heat treated. It can also be noted that in order to compensate for the negative effect on ejection behaviour of substance A, substance B had to be added in an amount of more than 0.5 times the amount of added substance A.

The compositions that resulted in sufficient green strength i.e. compositions 7, 12, 13, 14, and 15 were used in a second test where flaking during drilling was measured. The compositions were prepared similarly to previous stated procedures, with the exception that MnS was added to the compositions. As iron powder ASC100.29 available from Höganäs AB was used. Further 2.18% of copper powder, Cu-200 available from Ecka, 0.8% graphite, UF4 available from Firma Kropfmuhle, and 0.45% MnS available from Höganäs AB was added. A reference mix was used where 0.45% Kenolube available from Höganäs AB was added as lubricant.

120×30×8 mm parts were compacted to a density of 6.75 g/cm$^3$. The drilling test was performed in a Haas VF2 CNC cutter where feed rate, cutting speed and drill tip angle was varied. The parts were heat treated at 225° C. in inert atmosphere before the drilling test was performed. 27 holes were drilled on each part and the flaking of the holes was analysed as well as the green strength of the parts after heat treatment.

Table 3 shows the results from the measurements.

TABLE 3

Results from measurements of flaking and heat treated green strength.

| Composition | Total organic content [%] | Total MnS content [%] | Flaking | Green strength, heat treatment 225° C. [MPa] |
|---|---|---|---|---|
| 7 | 0.8 | — | ++ | 44 |
| 7 + MnS | 0.45 | 0.45 | +++ | 44 |
| 12 + MnS | 0.45 | 0.45 | +++ | 34 |
| 13 + MnS | 0.45 | 0.45 | +++ | 35 |
| 14 + MnS | 0.45 | 0.45 | +++ | 69 |
| 15 + MnS | 0.45 | 0.45 | +++ | 77 |
| Ref. mix with Kenolube | 0.45 | 0.45 | + | 18 |

Table 3 shows that lubricant combinations according to the present invention results in higher heat treated green strength compared with a conventional lubricant like Kenolube. The higher heat treated green strength also resulted in less flaking during drilling. Addition of MnS to the compositions resulted in less flaking compared with no addition of MnS but it did not affect the heat treated green strength.

The invention claimed is:

1. A metal powder composition comprising:

an iron or iron-based powder composition, and a lubricating combination comprising a substance A, a substance B, and a substance C; wherein:

substance A is a polyolefin, substance B is chosen from a group consisting of saturated and unsaturated fatty acid amides, saturated and unsaturated fatty acid bisamides, saturated fatty alcohols and fatty acid glycerols, and substance C is an amide oligomer having a molecular weight between 500 g/mol and 30,000 g/mol, wherein substance C is different from substance A and substance B; and wherein amounts of respective substances A, B and C in weight percent of the iron or iron-based powder composition are:

$$0.05<A+B<0.4 \text{ wt \%},$$

$$C>0.3 \text{ wt \%},$$

$$A+B+C<2.0 \text{ wt \%, and}$$

a relation between substances A and B is: B/A>0.5.

2. A metal powder composition according to claim 1 wherein substance B is chosen from a group consisting of saturated and unsaturated fatty acid amides, unsaturated fatty acid bisamides, saturated fatty alcohols and fatty acid glycerols.

3. A metal powder composition according to claim 1 wherein substance A is a polyolefin having a weight average molecular weight of 400 g/mol-10,000 g/mol.

4. A metal powder composition according to claim 1 wherein substance B is chosen from a group consisting of the saturated and unsaturated fatty acid amides lauric acid amide, myristic acid amide, palmitic acid amide, stearic acid amide, oleic acid amide, archaic acid amide, behenic acid amide and erucic acid amide; the unsaturated fatty acid bisamides ethylene-bis-oleamide, ethylene-bis-erucamide, hexylen-bis-oleamide and hexylene-bis-erucamide; the saturated fatty alcohols myristc alcohol, cetyl alcohol, stearyl alcohol, archidyl alcohol and behenyialcohol; and the saturated fatty acid glycerols glycerol 1-monostearate and glycerol 1,2-distearate.

5. A metal powder composition according to claim 1 wherein substance C is an amide oligomer having a weight average molecular weight between 1000 g/mol and 15,000 g/mol.

6. A metal powder composition according to claim 1 wherein the composition has a mean particle size of 50-500 μm.

7. A metal powder composition according to claim 1 wherein the composition has a mean particle size of 150-400 μm.

8. A metal powder composition according to claim 1 wherein the composition comprises at least one of graphite, copper, nickel, molybdenum, vanadium, chromium, niobium, manganese, phosphorous manganese sulfide, boron nitride and a metal oxide.

9. A metal powder composition according to claim 1 wherein substance C is an amide oligomer having a melting point between 120° C.-200° C.

10. A metal powder composition according to claim 1 wherein substance C is an amide oligomer that is derived from a lactam, a diamine or a dicarboxylic acid.

11. A compacted component comprising the metal powder composition according to claim 1, wherein the compacted component has a green strength of at least 30 MPa.

12. A method for producing a metal powder composition comprising the steps of:

providing a lubricating combination comprising a substance A, a substance B, and a substance C;

mixing the lubricating combination with an iron or iron-based powder;

heating the mixture to a temperature above the melting point peak for substance A but below the melting point peak for substance C;

cooling the heated mixture during mixing in order to bond finer particles to the surface of the iron- or iron-based powder particles, wherein:

substance A is a polyolefin, substance B is chosen from a group consisting of saturated and unsaturated fatty acid amides, saturated and unsaturated fatty acid bisamides, saturated fatty alcohols and fatty acid glycerols, and substance C is an amide oligomer having a molecular weight between 500 g/mol and 30,000 g/mol, wherein substance C is different from substance A and substance B; and wherein the amounts of respective substances A, B and C in weight percent of the iron or iron-based powder composition are:

$$0.05<A+B<0.4 \text{ wt \%},$$

$$C>0.3 \text{ wt \%},$$

$$A+B+C<2.0 \text{ wt \%, and}$$

the relation between substances A and B is: B/A>0.5.

13. The method of claim 12, wherein, in the heating step, the mixture is heated to a temperature above the melting point peak of substance B.

14. The method of claim 12, wherein the iron or iron-based powder includes graphite and/or other alloying element, hard phase material, machining enhancing agent and/or sintering enhancing agent.

15. The method of claim 12, further comprising adding a flow enhancing agent during the cooling step.

16. A method for producing a green component having enhanced green strength comprising the steps of:

providing a metal powder composition produced according to the method of claim 12;

compacting the metal powder composition in a die at a die temperature between ambient temperature and 100° C. at a compaction pressure of 400-1,500 MPa to obtain a compacted component; and ejecting the compacted component from the die.

17. The method of claim 16, further comprising the step of heating the ejected component in air or in an inert atmosphere at a temperature above the melting temperature but below the decomposition temperature of substance C.

18. The method of claim 16, further comprising the step of machining the component.

19. A metal powder composition comprising:

an iron or iron-based powder composition, and a lubricating combination comprising a substance A, a substance B, and a substance C; wherein:

substance A is a polyolefin, substance B is chosen from a group consisting of saturated and unsaturated fatty acid amides, saturated and unsaturated fatty acid bisamides, saturated fatty alcohols and fatty acid glycerols, and substance C is an amide oligomer having a molecular weight between 500 g/mol and 30,000 g/mol, wherein substance C is different from substance A and substance B, and substance C has a melting point peak which above the melting point peak of substance A and the melting point peak of substance B; and wherein amounts of respective substances A, B and C in weight percent of the iron or iron-based powder composition are:

$$0.05<A+B<0.4 \text{ wt \%},$$

$$C>0.3 \text{ wt \%},$$

$$A+B+C<2.0 \text{ wt \%, and}$$

a relation between substances A and B is: B/A>0.5.

20. The metal powder composition according to claim 19, wherein substance C is an amide oligomer having a weight average molecular weight between 1000 g/mol and 15,000 g/mol.

* * * * *